US006899158B2

(12) United States Patent
Matuura et al.

(10) Patent No.: US 6,899,158 B2
(45) Date of Patent: May 31, 2005

(54) INSERT CORE AND METHOD FOR MANUFACTURING A CYLINDER FOR INTERNAL COMBUSTION ENGINE BY MAKING USE OF THE INSERT CORE

(75) Inventors: Fujihiro Matuura, Kanagawa (JP); Takio Shoji, Kanagawa (JP); Daiju Yamada, Kanagawa (JP)

(73) Assignee: Kioritz Corporation, Tokyo (JP)

( * ) Notice: Subject to any disclaimer, the term of this patent is extended or adjusted under 35 U.S.C. 154(b) by 0 days.

(21) Appl. No.: 10/654,213

(22) Filed: Sep. 3, 2003

(65) Prior Publication Data

US 2004/0089436 A1 May 13, 2004

(30) Foreign Application Priority Data

Sep. 4, 2002 (JP) ..... 2002-259132

(51) Int. Cl.[7] ..... B22D 17/00

(52) U.S. Cl. ..... 164/113; 164/131; 164/138; 123/193.3

(58) Field of Search ..... 164/113, 312, 164/131, 132, 138, 140; 123/193.3

(56) References Cited

U.S. PATENT DOCUMENTS 3,844,334 A * 10/1974 Frederickson ..... 164/132

6,345,439 B2 2/2002 Matuura et al. ..... 29/888.06

* cited by examiner

*Primary Examiner*—Kiley S. Stoner
*Assistant Examiner*—I.-H. Lin
(74) *Attorney, Agent, or Firm*—Baker Botts LLP

(57) ABSTRACT

There is provided a method for manufacturing a cylinder for an internal combustion engine by making use of an insert core, which makes it possible to manufacture the cylinder by a die casting method such as a high-pressure die casting method at low cost and in high accuracy. The insert core to be employed herein includes: a cylindrical body having substantially the same outer diameter as the diameter of bore of the cylinder to be obtained; a scavenging port-forming portion projecting radially outward from the cylindrical body and having substantially the same cross-sectional configuration as that of the scavenging port; a suction port-forming portion projecting radially outward from the cylindrical body and having substantially the same cross-sectional configuration as that of at least the cylinder bore-side end portion of a suction port; and an exhaust port-forming portion projecting radially outward from the cylindrical body and having substantially the same cross-sectional configuration as that of at least the cylinder bore-side end portion of an exhaust port.

4 Claims, 15 Drawing Sheets

INSERT CORE AND METHOD FOR MANUFACTURING A CYLINDER FOR INTERNAL COMBUSTION ENGINE BY MAKING USE OF THE INSERT CORE

BACKGROUND OF THE INVENTION

1. Field of the Invention

The present invention relates to an insert core to be employed in a method for manufacturing a cylinder for an internal combustion engine such as a small air-cooled two-stroke gasoline engine which is suited for use, for example, in a portable power working machine, and to a method of manufacturing the cylinder by making use of the insert core. In particular, the present invention relates to a method of manufacturing the cylinder by making use of an insert core which enables an undercut portion of the cylinder such as a scavenging port to be rationally formed on the occasion of manufacturing the cylinder by a die casting method such as a high-pressure die casting method.

2. Description of the Related Art

The cylinder of a small air-cooled two-stroke gasoline engine to be used in a portable power working machine is, as seen for instance from JP Laid-open Patent Publication (Kokai) No. 58-155114 (1983), generally formed of an aluminum alloy and constituted by an integral body including a main body having a cylinder bore formed therein for allowing a piston to be fitted therein, and a head portion having a squish dome-shaped combustion chamber formed therein, and by a large number of cooling fins projecting from all over the outer wall of the integral body.

The cylinder bore is provided with a suction port and also with an exhaust port, both of which are designed to be closed or opened by the movement of the piston. These suction port and exhaust port are disposed to face each other in an off-set manner so that they disagree in level from each other. A plurality of hollow scavenging passageways (scavenging duct), each being displaced away from these suction port and exhaust port by an angle of 90 degrees and having an inner wall of predetermined thickness, are formed along with the cylinder bore. The downstream end portion (upper end portion) of each hollow scavenging passageway (scavenging duct) is constituted by a scavenging port, thereby providing a pair of scavenging ports which are disposed opposite to each other and designed to be opened and closed by the piston. These scavenging ports are inclined somewhat upward in the direction opposite to the exhaust port of the cylinder bore.

The cylinder disclosed in the aforementioned JP Laid-open Patent Publication (Kokai) is a so-called binary fluid scavenging type cylinder where a pair of scavenging ports are symmetrically formed with respect to the longitudinal section taken along the middle of the exhaust port. Additionally, a so-called quaternary fluid scavenging type cylinder where a pair of scavenging ports are additionally provided therewith (two pairs of scavenging ports in total) is also known in the art.

As for the type of the scavenging passageway, also known in the art are a hollow scavenging passageway (scavenging duct) provided with an inner wall as shown in the aforementioned JP Laid-open Patent Publication (Kokai), a scavenging passageway having no inner wall (the side facing the cylinder bore is opened), and a scavenging passageway (scavenging duct) provided with a half-wall having a prescribed thickness as disclosed in JP Laid-open Patent Publication (Kokai) No. 2000-34924 which belongs to the same assignee as that of the present application. The last mentioned scavenging duct is featured in that it is provided at a lower portion thereof with an opening extending in the longitudinal direction of the scavenging duct while leaving a half-wall having a predetermined thickness at an upper portion thereof so as to allow an air-fuel mixture introduced into the scavenging port from the crank chamber via the scavenging duct to be contacted with a skirt portion of the piston.

When a cylinder provided with a scavenging duct in particular among the aforementioned cylinders for a two-stroke internal combustion engine is to be manufactured by a die casting method such as a high-pressure die casting method which enables cast moldings of high dimensional accuracy to be produced at low cost, the scavenging port portion of the scavenging duct which constitutes an undercut portion has been generally formed as follows. Namely, since a collapsible core cannot be employed under a high pressure, a raw cylinder body is cast-molded at first in such a manner that the scavenging port portion (constituting an undercut portion) thereof is left closed, and thereafter, this closed scavenging port portion is cut out by mechanical means (see JP Laid-open Patent Publication (Kokai) No. 58-155114 (1983)).

There is a problem however in the aforementioned method to cut out a scavenging port by mechanical means after the casting of raw cylinder body. Namely, since the space for allowing a cutting tool to be inserted into a working portion is very narrow, it is very difficult to perform the mechanical working and to enhance the working accuracy of the scavenging port. Since the performance of a two-stroke internal combustion engine is greatly influenced by the size and configuration of the scavenging port as well as by the working accuracy thereof, the aforementioned problem accompanied with the aforementioned mechanical working is very important.

It may be conceivable to manufacture a cylinder provided with a scavenging duct by a die casting method employing an insert core to be inserted into the scavenging port portion. In this case however, since part of the insert core is left to remain in the cast product, the heat conductivity thereof is deteriorated and at the same time, various problems such as the deformation or peeling of the part of the insert core may occur.

With a view to overcome the aforementioned problems, the present inventors have previously proposed a method for manufacturing a cylinder for an internal combustion engine, where an insert core is employed as described below (see JP Laid-open Patent Publication (Kokai) No. 2000-145536). Namely, according to this method, first of all, an insert core comprising a cylinder body and a scavenging port-forming portion projecting radially outward from the cylindrical body is prepared. The cylinder body has an outer diameter which is substantially the same as the diameter of bore of the cylinder to be obtained, and the scavenging port-forming portion has substantially the same cross-sectional configuration as that of the scavenging port. Then, the cast-molding of the cylinder is performed by setting the insert core in such a manner that the insert core is externally inserted over a bore-core die to obtain a raw cylinder body with the insert core remaining therein. Thereafter, the cylinder bore of the resultant raw cylinder body is subjected to boring to cut and remove the cylindrical portion of the insert core, and then, the scavenging port-forming portion of the insert core which remains in the raw cylinder body is removed by making use of a press, etc.

According to the aforementioned manufacturing method, since the aforementioned insert core is employed, it is possible to utilize a high-pressure die casting method which enables to obtain a cast article of high dimensional accuracy. Moreover, since the cylindrical portion of the insert core can be removed by way of a rough boring of the cylinder bore after the die casting, and since the scavenging port-forming portion of the insert core that could not have been removed by the rough boring can be removed by making use of a press after the die casting, it is possible to make the resultant cast article (cylinder) completely free from any residuals of the insert core. As a result, a cylinder can be manufactured in higher accuracy and at lower cost as compared with the conventional method of cutting out the scavenging port portion by mechanical means after die casting or with the conventional manufacturing method by die casting where an insert core to be inserted into the scavenging port portion is employed. At the same time, the aforementioned problems of the deterioration of heat conductivity, and troubles such as the deformation or peeling of the insert portions due to the remnant of the insert core in the cast article (cylinder) can be prevented to occur.

However, even in the aforementioned manufacturing method, the following problems are raised. Namely, according to the aforementioned manufacturing method, it is required, for the purpose of forming an suction port and an exhaust port, to prepare a core for suction port as well as a core for exhaust port in separate from the aforementioned insert core, and the die casting of the cylinder by way of a high-pressure die casting method is performed with the core for suction port being set in the bore-core die (a lower bore-forming portion thereof) and with the core for exhaust port being set in the aforementioned insert core. In this case however, since the scavenging port-forming portion, the suction port-forming portion and the exhaust port-forming portion are separately prepared, it is possible that the scavenging port, the suction port and the exhaust port are erroneously dislocated from each other due to assembling error on the occasion of setting these cores as well as due to mismatching of mold on the occasion of cast molding.

In this case, since the scavenging port, the suction port and the exhaust port are designed to be opened and closed by the piston, if these ports are relatively dislocated each other from predetermined positions thereof, in particular, if there is an error in distance in elevational direction (the elevational direction of the cylinder) among them, the opening and closing timing of these ports by the piston may become inappropriate, thus making it impossible to obtain desired performance of the engine.

BRIEF SUMMARY OF THE INVENTION

The present invention has been made to overcome the aforementioned problems, and therefore an object of the present invention is to provide a method for manufacturing a cylinder for an internal combustion engine, which not only makes it possible to manufacture the cylinder by a die casting method such as a high-pressure die casting method at low cost and in high accuracy without raising problems such as the deterioration of heat conductivity, and the deformation or peeling of the insert portions, but also makes it possible to prevent the generation of relative mismatching among the scavenging port, the suction port and the exhaust port of the cylinder to be obtained.

With a view to realize the aforementioned object, the present invention provides an insert core which is designed to be used in the manufacture of a cylinder provided with a scavenging duct having a scavenging port to be opened and closed by the movement of a piston, the insert core being featured in that it comprises a cylindrical body having substantially the same outer diameter as the diameter of bore of the cylinder to be obtained, a scavenging port-forming portion projecting radially outward from the cylindrical body and having substantially the same cross-sectional configuration as that of the scavenging port, an suction port-forming portion projecting radially outward from the cylindrical body and having substantially the same cross-sectional configuration as that of at least the cylinder bore-side end portion of an suction port, and an exhaust port-forming portion projecting radially outward from the cylindrical body and having substantially the same cross-sectional configuration as that of at least the cylinder bore-side end portion of an exhaust port.

Preferably, the insert core is formed as an integral body by a die casting method using an aluminum alloy as a raw material.

As for the material for the insert core, it is not limited to the aforementioned aluminum alloy, but any other iron family metals can be employed. If the same kind of aluminum alloy as that of the cylinder is employed as a material for the insert core, the content of an additive such as silicon in the insert core may be increased larger than that of the cylinder, thereby enhancing the melting point of the insert core than that of the cylinder to thereby prevent the generation of a fusion bonding between the insert core and the cylinder.

On the other hand, the method of manufacturing a cylinder for an internal combustion engine according to the present invention is featured in that the cylinder is manufactured by means of a die casting method.

According to an exemplary embodiment, the cylinder is manufactured by a process wherein the insert core is externally attached to a bore-core die, the resultant casting die is then employed to cast-mold a raw cylinder body with the insert core remaining therein, the resultant raw cylinder body is then subjected to boring for forming a cylinder bore to remove a cylindrical portion of the insert core, and the scavenging port-forming portion, suction port-forming portion and exhaust port-forming portion of the insert core, which remain in the raw cylinder body, are removed by making use of a press, etc.

It is preferable in this case to coat or plate a parting agent on the outer surface of at least the scavenging port-forming portion, suction port-forming portion and exhaust port-forming portion of the insert core, thereby forming a mold-releasing layer prior to the step of die casting.

As for the parting agent to be coated or plated on the outer surface of the insert core, chromium, nickel, carbon, etc. can be employed. The coating or plating of these parting agents may be performed using electrolytic plating or vapor deposition for instance, thus forming a mold-releasing layer.

According to the aforementioned exemplary embodiments of the method of manufacturing a cylinder for an internal combustion engine by making use of the insert core which is constructed according to the present invention, it is possible, due to the employment of the insert core, to utilize a high-pressure die casting method which enables to obtain a cast article of high dimensional accuracy. Additionally, since the cylindrical portion of the insert core can be removed by way of a rough boring of the cylinder bore after the die casting, and since the residual portion of the insert core (the scavenging port-forming portion, suction port-forming portion and exhaust port-forming portion of the insert core) that cannot be removed by the rough boring can be easily and simply removed by making use of a press after the die casting, it is possible to make the resultant article completely free from any residuals of the insert core.

As a result, a cylinder can be manufactured in higher accuracy and at lower cost as compared with the conventional method of cutting out the scavenging port portion by mechanical means after die casting or with the conventional manufacturing method by die casting where an insert core to be inserted into the scavenging port portion is employed. At the same time, the aforementioned problems of the deterioration of heat conductivity, and the deformation or peeling of these port portions due to the remnant of the insert core in the cast article (cylinder) can be prevented from occurring.

Furthermore, since all of these scavenging port-forming portion, suction port-forming portion and exhaust port-forming portion are formed integral with the insert core (the cylindrical portion thereof), it is possible to univocally determine the positions of the scavenging port, the suction port and the exhaust port, thereby preventing the generation of relative mismatching among the scavenging port, the suction port and the exhaust port that may be caused to occur in the conventional manufacturing method where these scavenging port-forming portion, suction port-forming portion and exhaust port-forming portion are provided separate from the insert core. Therefore, it is now possible to obtain a cylinder excellent in dimensional accuracy.

Additionally, since the configurations of these scavenging port-forming portion, suction port-forming portion and exhaust port-forming portion can be optionally selected as long as they can be detached or removed by pushing (or pulling) them toward the inside or outside of the cylinder bore after the die casting, the configuration, contraction ratio and inclination angle of these scavenging port, suction port and exhaust port can be optionally selected, thereby increasing the degree of freedom in designing these ports as compared with the case where these ports are formed by electric discharge machining and at the same time, it is possible to reduce the manufacturing cost of the cylinder.

DETAILED DESCRIPTION OF THE INVENTION

The present invention will be further explained with reference to one embodiment of the manufacturing method of a cylinder for an internal combustion engine where an insert core is employed according to the present invention.

Figure 15:
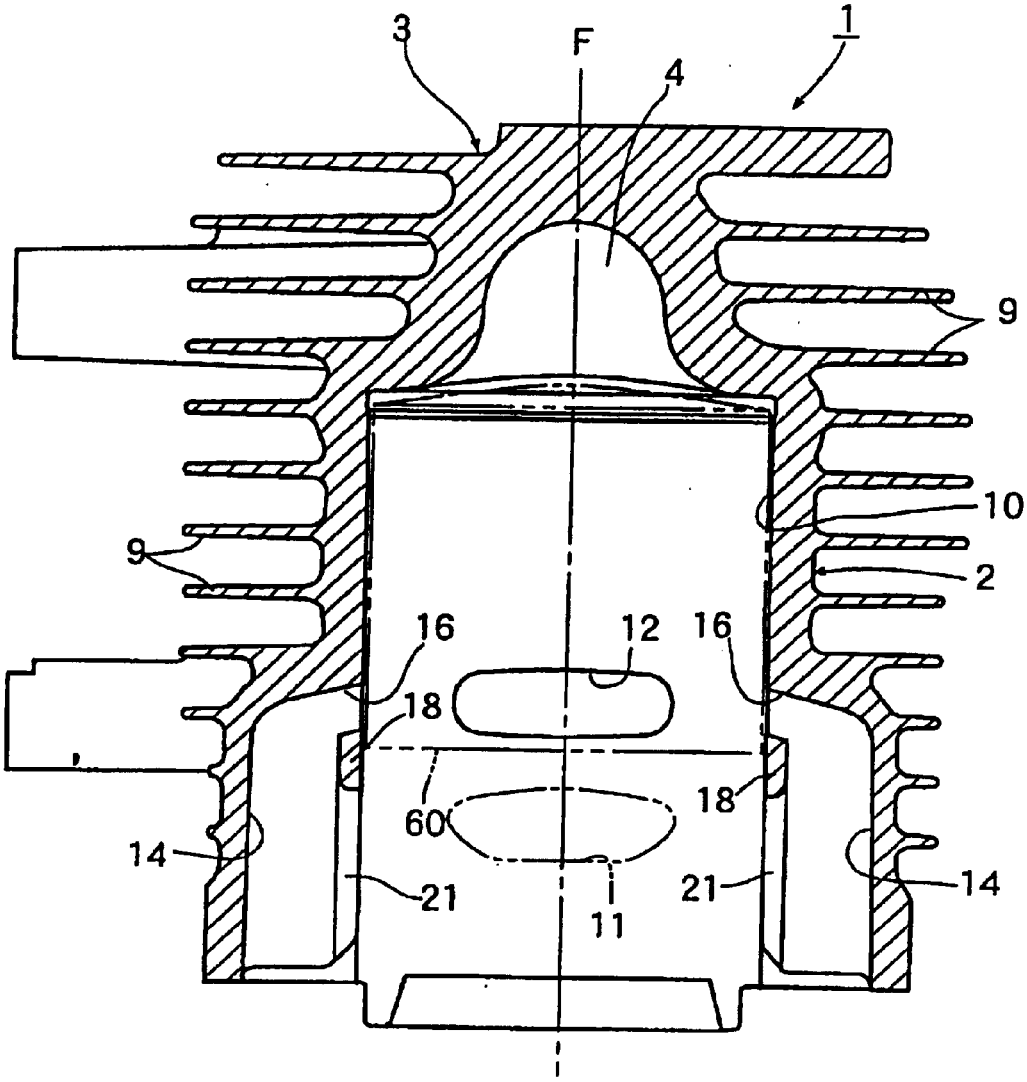
FIG. 15 is a longitudinal sectional view for illustrating a finished cylinder for a small air-cooled two-stroke internal combustion engine, which can be manufactured by the method of manufacturing a cylinder for an internal combustion engine using an insert core according to the present invention, wherein the scavenging duct is longitudinally sectioned.
Figure 16:
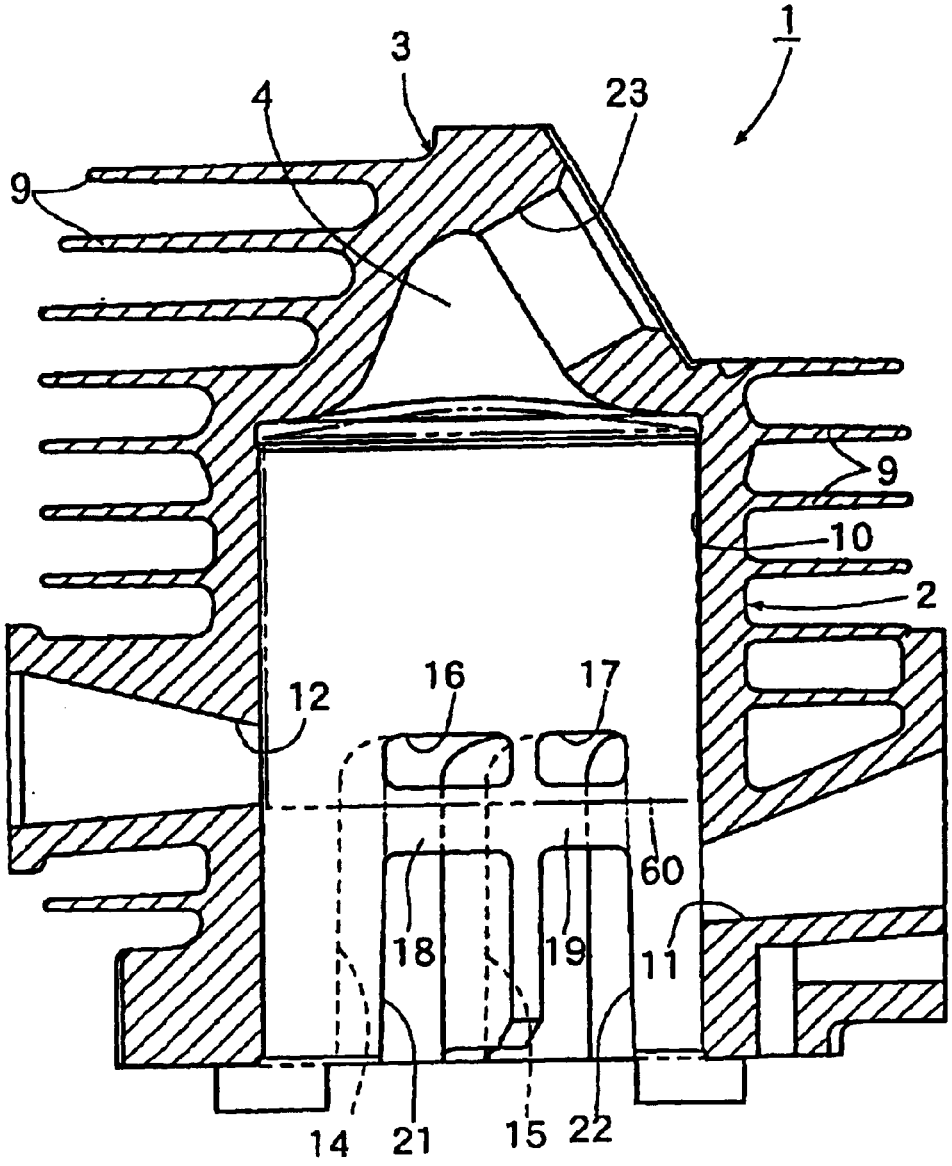
FIG. 16 is a longitudinal sectional view for illustrating a finished cylinder for a small air-cooled two-stroke internal combustion engine, which can be manufactured by the method of manufacturing a cylinder for an internal combustion engine using an insert core according to the present invention, wherein the suction port and the exhaust port are respectively longitudinally sectioned.

The cylinder for an internal combustion engine, which can be manufactured by the method according to this embodiment, is a cylinder 1 for a small air-cooled two-stroke gasoline engine as shown in FIG. 15 (a longitudinal sectional view wherein the scavenging duct thereof is longitudinally sectioned) and FIG. 16 (a longitudinal sectional view wherein the suction port and exhaust port thereof are longitudinally sectioned), which can be employed in a portable working machine. This cylinder 1 is formed of an aluminum alloy and comprises an integral body including a main body 2 having a cylinder bore 10 for allowing a piston 60 to be fitted therein, a head portion 3 provided therein with a squish dome-shaped combustion chamber 4, and a large number of cooling fins 9 which are formed all over the outer wall of the integral body. Further, the combustion chamber 4 is provided with an ignition plug-mounting hole 23 (in which an internal thread will be formed after cast molding).

The cylinder bore 10 is provided with a suction port 11 and with an exhaust port 12, which are to be closed and opened by the movement of the piston 60. The suction port 11 and exhaust port 12 are disposed to face each other and off-set level-wise from each other. Two pairs of scavenging ducts 14 and 15, each pair being displaced away from these suction port 11 and exhaust port 12 by an angle of 90 degrees, are formed along with the cylinder bore 10. Namely, the cylinder 1 in this case is a so-called quaternary fluid scavenging type cylinder where two pairs of scavenging ports are symmetrically formed with respect to the longitudinal cross-section F taken along the middle of the exhaust port 12. The downstream end portion (upper end portion) of each scavenging duct 14 (or 15) is constituted by a scavenging port 16 (or 17), thereby providing two pairs of scavenging ports 16 and 17 disposed opposite to each other, which are designed to be opened and closed by the movement of the piston 60 and are inclined somewhat upward in the direction opposite to that of the exhaust port 12 (i.e. directed toward the suction port 11) of the cylinder 10.

These scavenging duct 14 and 15 are respectively provided with a half wall, so that each scavenging duct is provided at a lower portion thereof with an opening 21 extending in the longitudinal direction of the scavenging duct and positioned below the half wall 18 or with an opening 22 extending in the longitudinal direction of the scavenging duct and positioned below the half wall 19, while leaving the half walls 18 and 19 at an upper portion thereof so as to allow an air-fuel mixture being introduced into the scavenging port from the crank chamber via the scavenging duct to be contacted with the skirt portion of the piston. These half-walls 18 and 19 in this case are respectively constructed to have the same inner diameter as that of the cylinder bore 10 and a predetermined thickness.

In the manufacturing method according to the present invention, an insert core 30 as shown in FIGS. 1 to 4 can be employed. Namely, this insert core 30 shown in these FIGS. is formed of an integrally molded body that can be obtained by a die casting method and comprises: a cylindrical body 32 having substantially the same outer diameter as (slightly smaller than) the diameter of the bore of the cylinder 1 to be obtained; two pairs of scavenging port-forming portions 36 and 37, each pair being positioned opposite to each other, projecting radially outward from the cylindrical body 32 and having substantially the same cross-sectional configuration as that of the scavenging ports 16 and 17, respectively; a suction port-forming portion 41 projecting radially outward from the cylindrical body and having substantially the same cross-sectional configuration as that of the cylinder bore-side end portion of the suction port 11; and an exhaust port-forming portion 42 projecting radially outward from the cylindrical body and having substantially the same cross-sectional configuration as that of at least the cylinder bore-side end portion of the exhaust port 12.

In this case, in the same manner as the positional relationships of the suction port 11 and the exhaust port 12 with respect to each of the scavenging ports 16 and 17 of the cylinder 1, these suction port-forming portion 41 and exhaust port-forming portion 42 are disposed to face each other in an off-set manner so that they disagree in level from each other and displaced away from these scavenging ports 16 and 17 by an angle of about 90 degrees.

Figure 1:
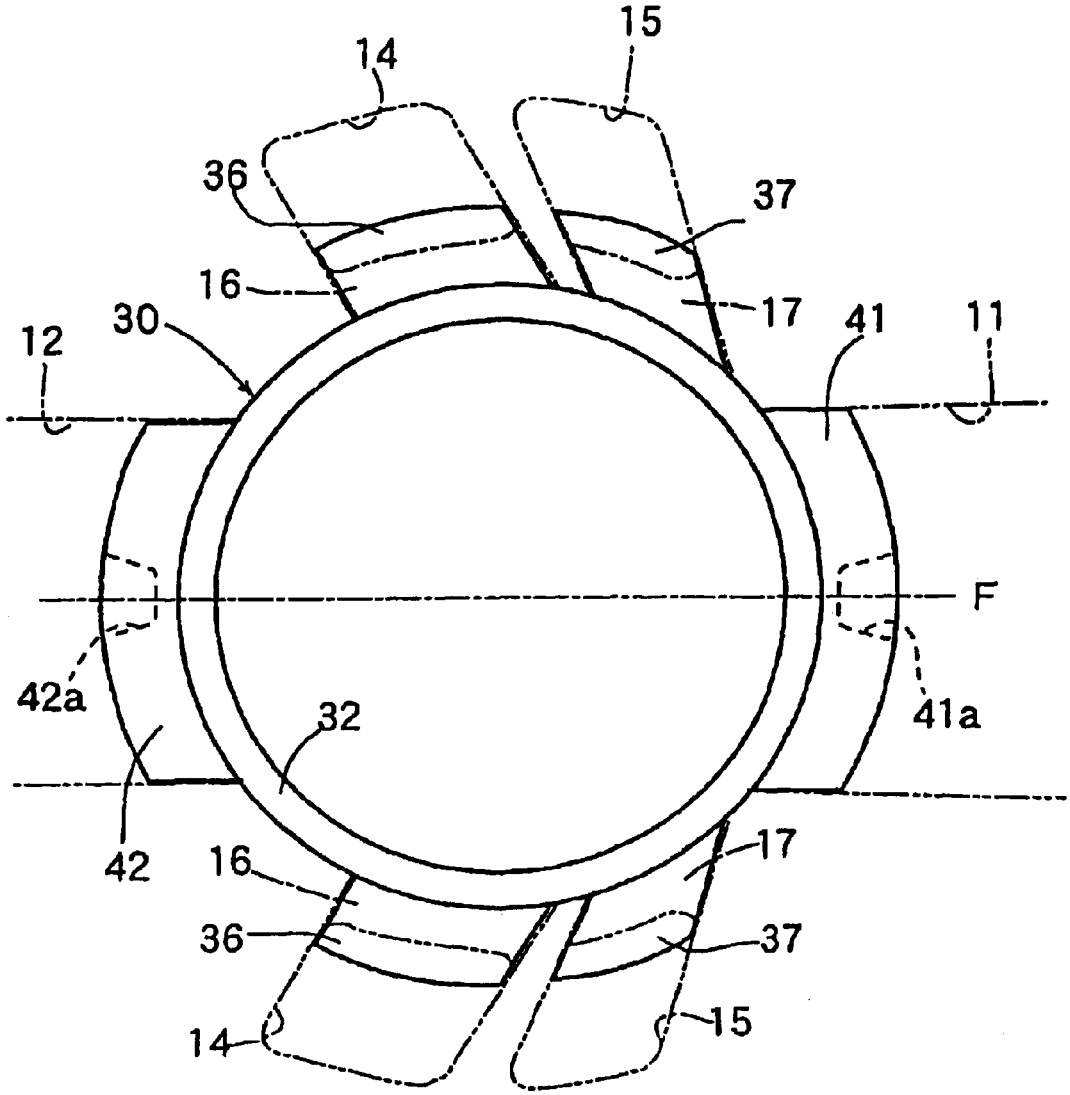
FIG. 1 is a plan view illustrating one embodiment of the insert core according to the present invention.
Figure 2:
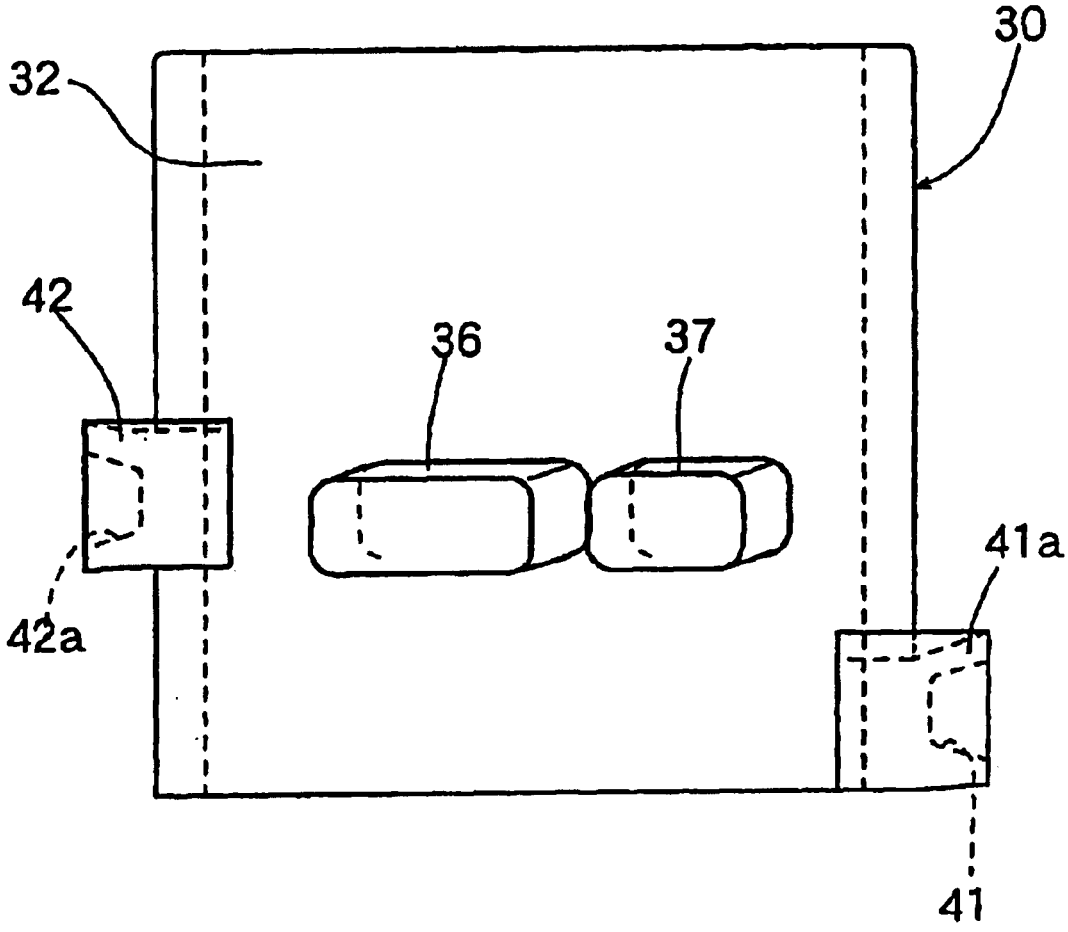
FIG. 2 is a side view of the insert core shown in FIG. 1.
Figure 3:
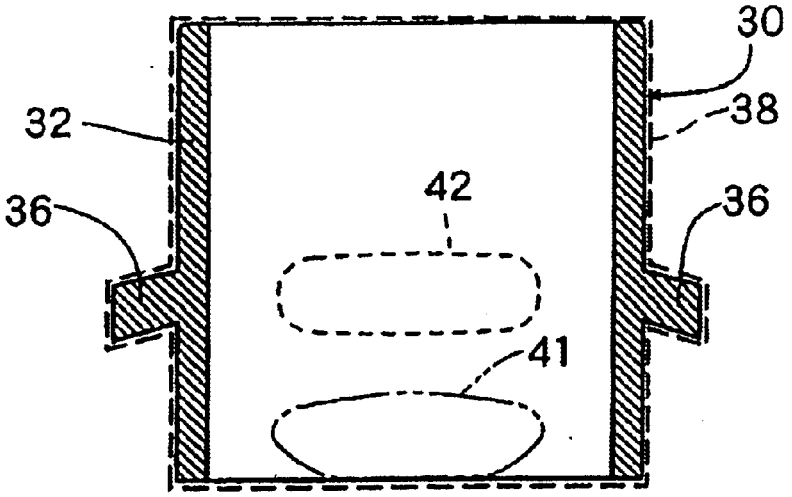
FIG. 3 is a longitudinal sectional view of the scavenging port-forming portion of the insert core shown in FIG. 1.
Figure 4:
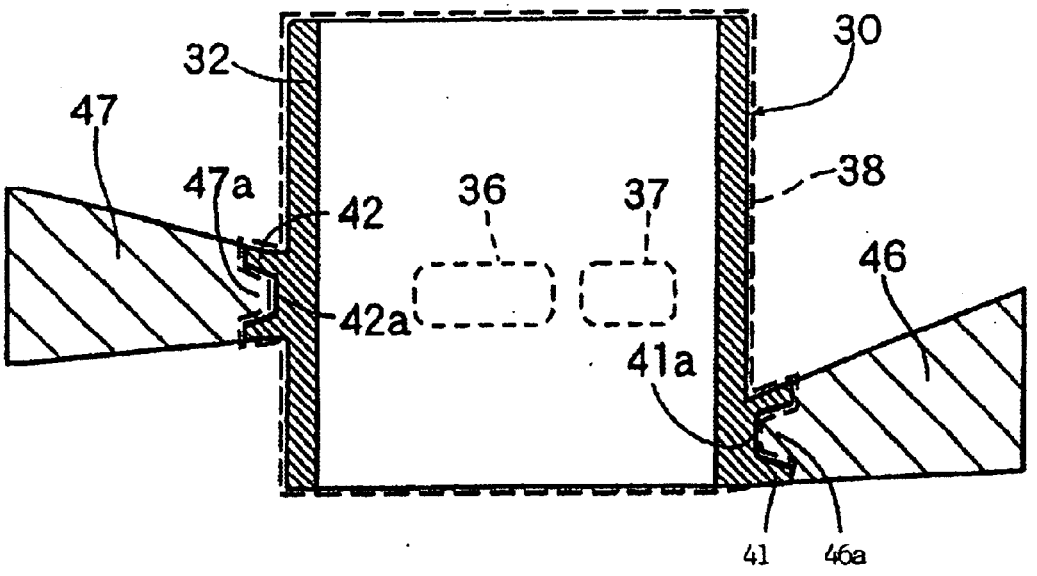
FIG. 4 is a longitudinal sectional view illustrating a sectional view of each of the suction port-forming portion and the exhaust port-forming portion of the insert core shown in FIG. 1.

As seen from FIG. 4, these suction port-forming portion 41 and exhaust port-forming portion 42 are provided respectively with fitting holes 41*a* and 42*a*, into which truncated cone-shaped bosses 46*a* and 47*a* formed respectively at the distal end portion of the core 46 for suction port and of the core 47 for exhaust port are designed to be fitted. In this case, each of these cores 46 and 47 has a cross-sectional configuration which is approximately the same cross-sectional configuration as that of each of the suction port 11 and the exhaust port 12 excluding the cylinder bore-side end portion thereof, these cores 46 and 47 being formed from steel, etc., thereby enabling them to be repeatedly used. These fitting holes 41*a* and 42*a* are useful for the positioning the cores and for preventing the falling-off of the cores and at the same time, useful for reducing the quantity of the material to be employed for these cores.

All of the scavenging port-forming portions 36 and 37, the suction port-forming portion 41, the exhaust port-forming portion 42, the core 46 for suction port, and the core 47 for exhaust port can be respectively increasingly enlarged in cross-sectional configuration in outward direction.

Additionally, the outer surface of the insert core 30 is entirely covered with a mold-releasing layer 38 which may be formed by coating or plating a parting agent such as chromium or nickel.

The application of this mold-releasing layer 38 may be generally limited to the outer surfaces of the scavenging port-forming portions 36 and 37, the suction port-forming portion 41, and the exhaust port-forming portion 42. However, in view of preventing the surface portion of the cylinder bore 10 from being torn off on the occasion of cutting out the cylindrical portion 32 of the insert core 30 as discussed below, it is more advisable to form the mold-releasing layer 38 all over the outer surface of the insert core 30 as described above.

Figure 5:
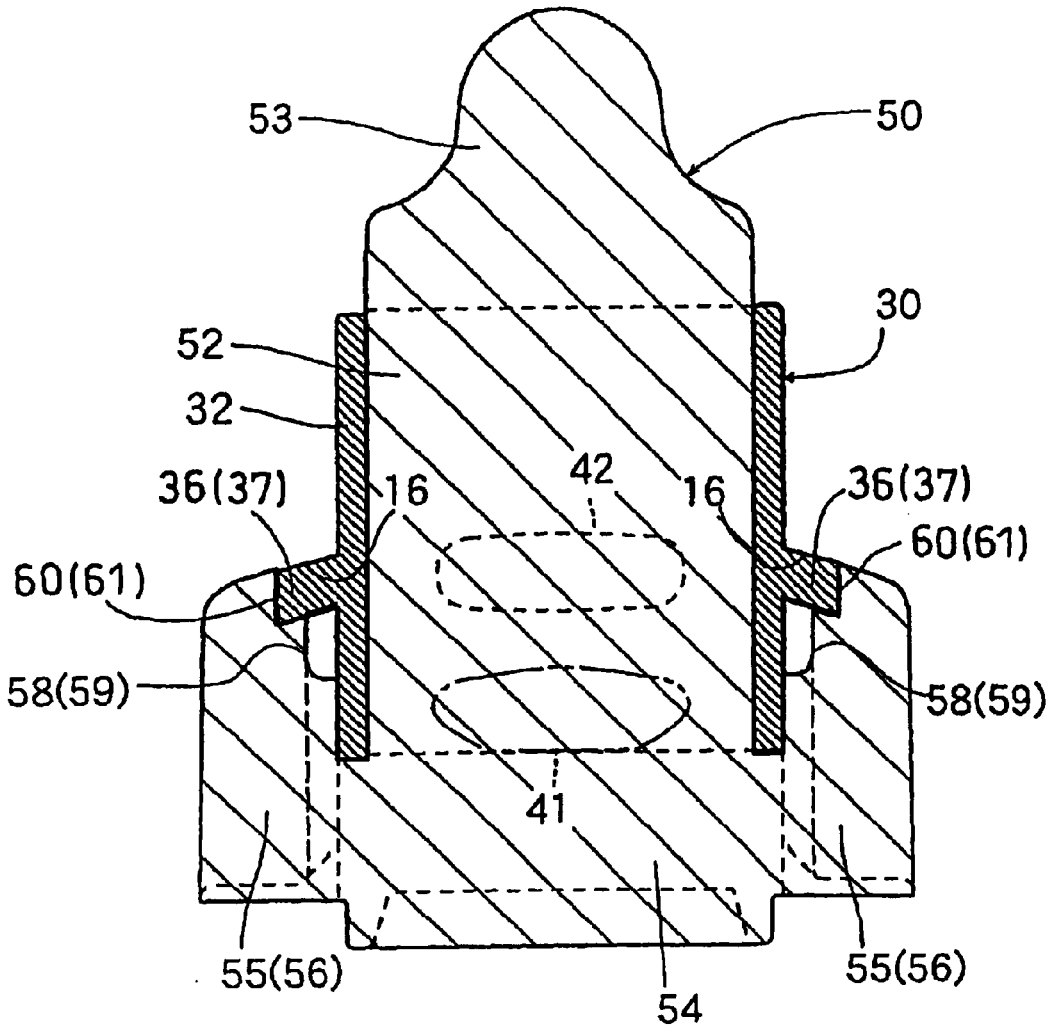
FIG. 5 is a longitudinal sectional view illustrating a state where the insert core shown in FIG. 1 is set in position in a bore-core die, and wherein the scavenging port-forming portion is longitudinally sectioned.
Figure 6:
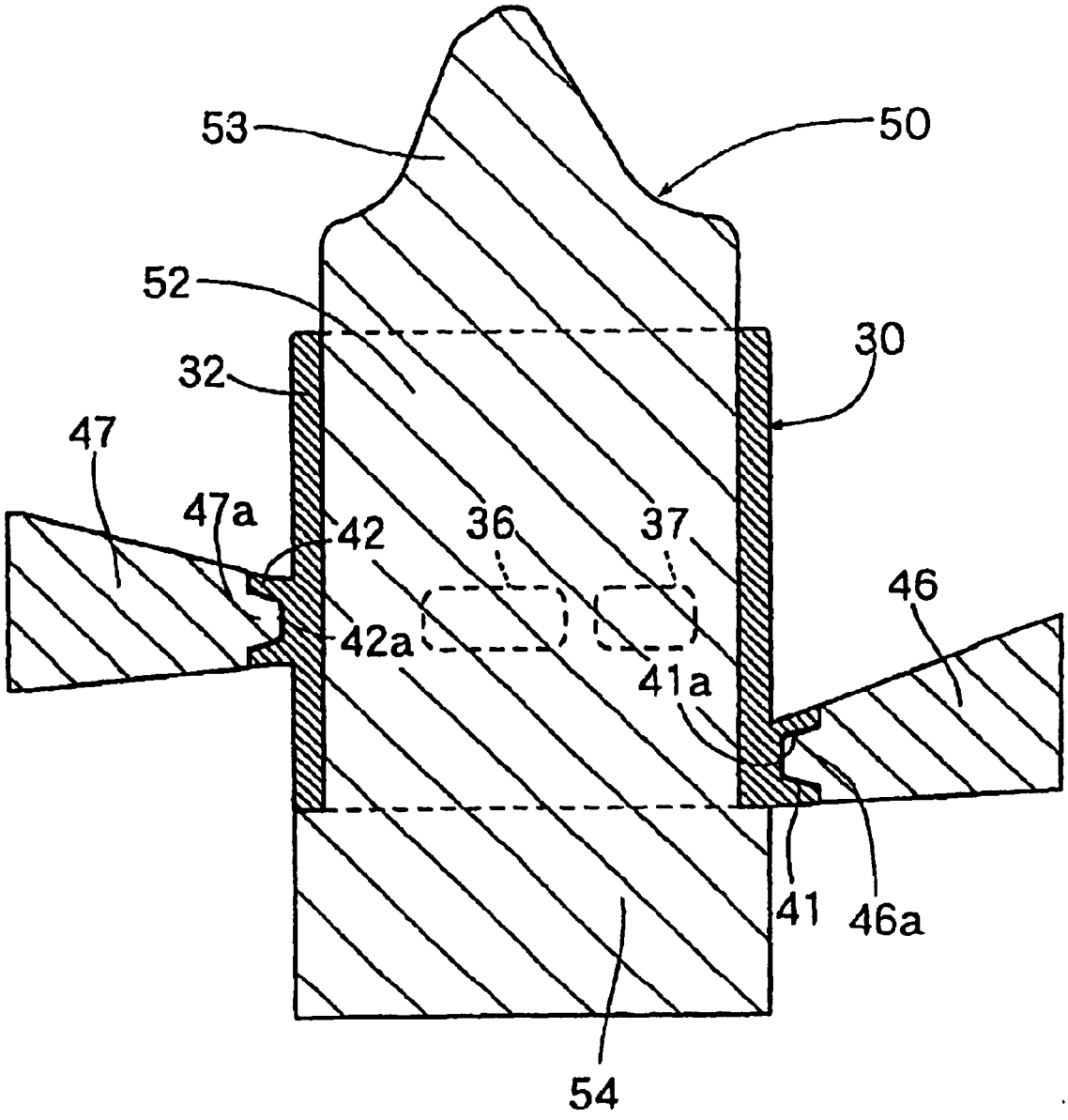
FIG. 6 is a longitudinal sectional view illustrating a state where the insert core shown in FIG. 1 is set in position in a bore-core die, and wherein the suction port-forming portion and the exhaust port-forming portion are respectively longitudinally sectioned.

In the manufacture of the cylinder 1 by making use of the aforementioned insert core 30, the insert core 30 is at first set in position over the bore-core die 50 as shown in FIGS. 5 and 6, and at the same time, the core 46 for suction port, and the core 47 for exhaust port are respectively mounted on the suction port-forming portion 41, and the exhaust port-forming portion 42 (the bosses 46*a* and 47*a* are fitted in the fitting holes 41*a* and 42*a*, respectively), thereby performing the relative positioning of these cores, and at the same time, preventing the fall-off of these cores.

The bore-core die 50 is an ordinary core die to be employed in a high pressure die casting method, and comprises a columnar bore insertion portion 52 on which the cylindrical portion 32 of the insert core 30 is fitted, a combustion chamber-forming portion 53 which is formed contiguous with the upper portion of the bore insertion portion 52 and configured to correspond with the combustion chamber 4 of the cylinder 1, a columnar lower bore portion-forming portion 54 which is formed contiguous with the lower end of the bore insertion portion 52, a pair of scavenging passage-forming portions 55 (56) which are formed contiguous with the right and left sides of the lower bore portion-forming portion 54, the scavenging passage-forming portions 55 (56) corresponding with the scavenging duct 14 and 15, respectively.

The bore insertion portion 52 has an outer diameter which is almost the same in size as the inner diameter of the insert core 30. Further, the lower bore portion-forming portion 54 has an outer diameter which is larger than the outer diameter of the bore insertion portion 52 but is almost the same as the outer diameter of the insert core 30, thereby enabling it to receive and engage with the cylindrical portion 32 of the insert core 30. Further, a pair of scavenging passage-forming portions 55 and another pair of scavenging passage-forming portions 56 shown in FIG. 4 are respectively provided with cut-out portions 60 (61) into which the scavenging port-forming portions 36 and 37 of the insert core 30 can be inserted and also provided with wall-forming portions 58 (59) which correspond with the configuration of the half walls 21 and 22.

Figure 7:
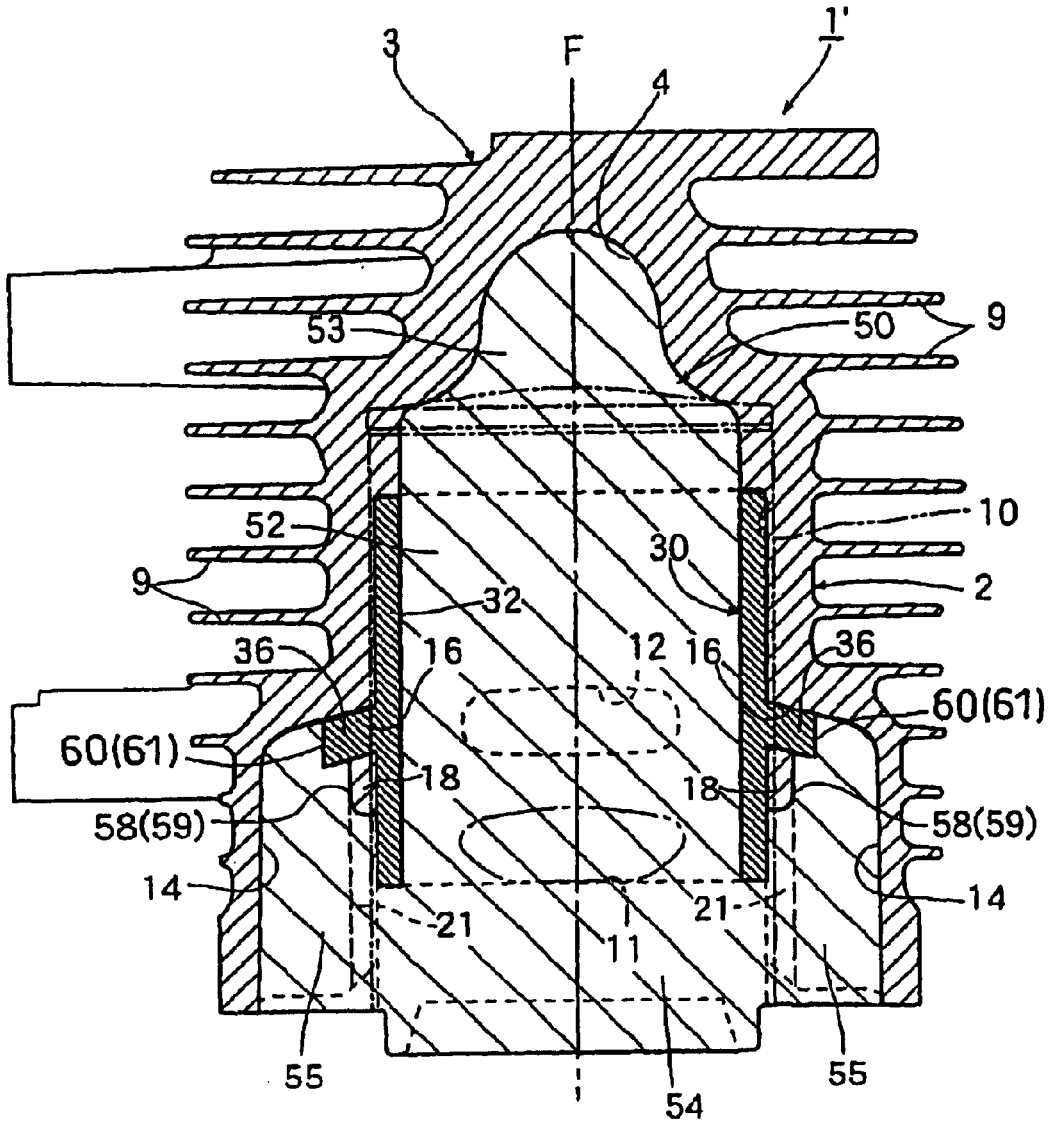
FIG. 7 is a longitudinal sectional view for illustrating the die casting process where the insert core shown in FIG. 1 and the bore-core die are employed, and wherein the scavenging duct is longitudinally sectioned.
Figure 8:
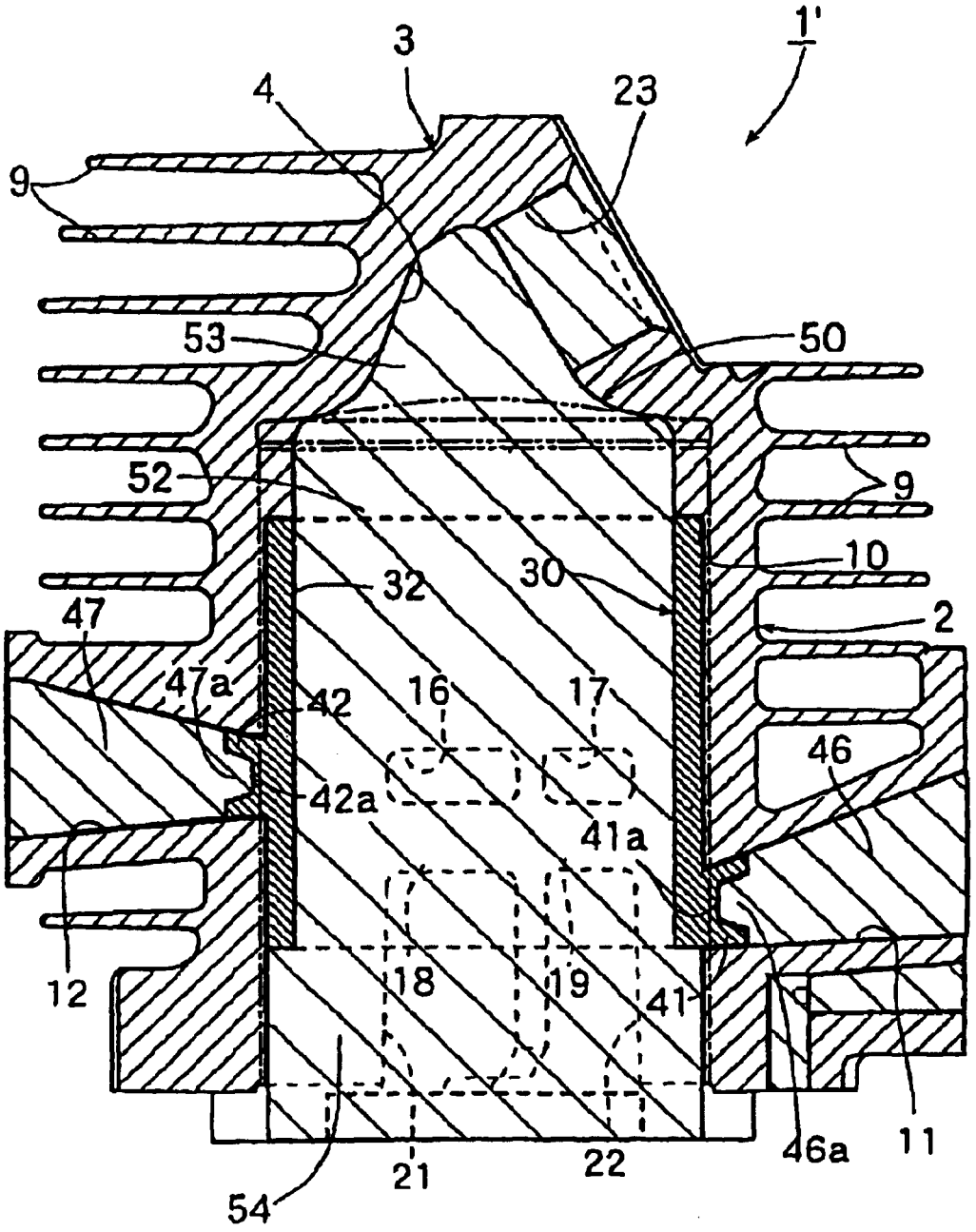
FIG. 8 is a longitudinal sectional view for illustrating the die casting process where the insert core shown in FIG. 1 and the bore-core die are employed, and wherein the suction port and the exhaust port are respectively longitudinally sectioned.
Figure 9:
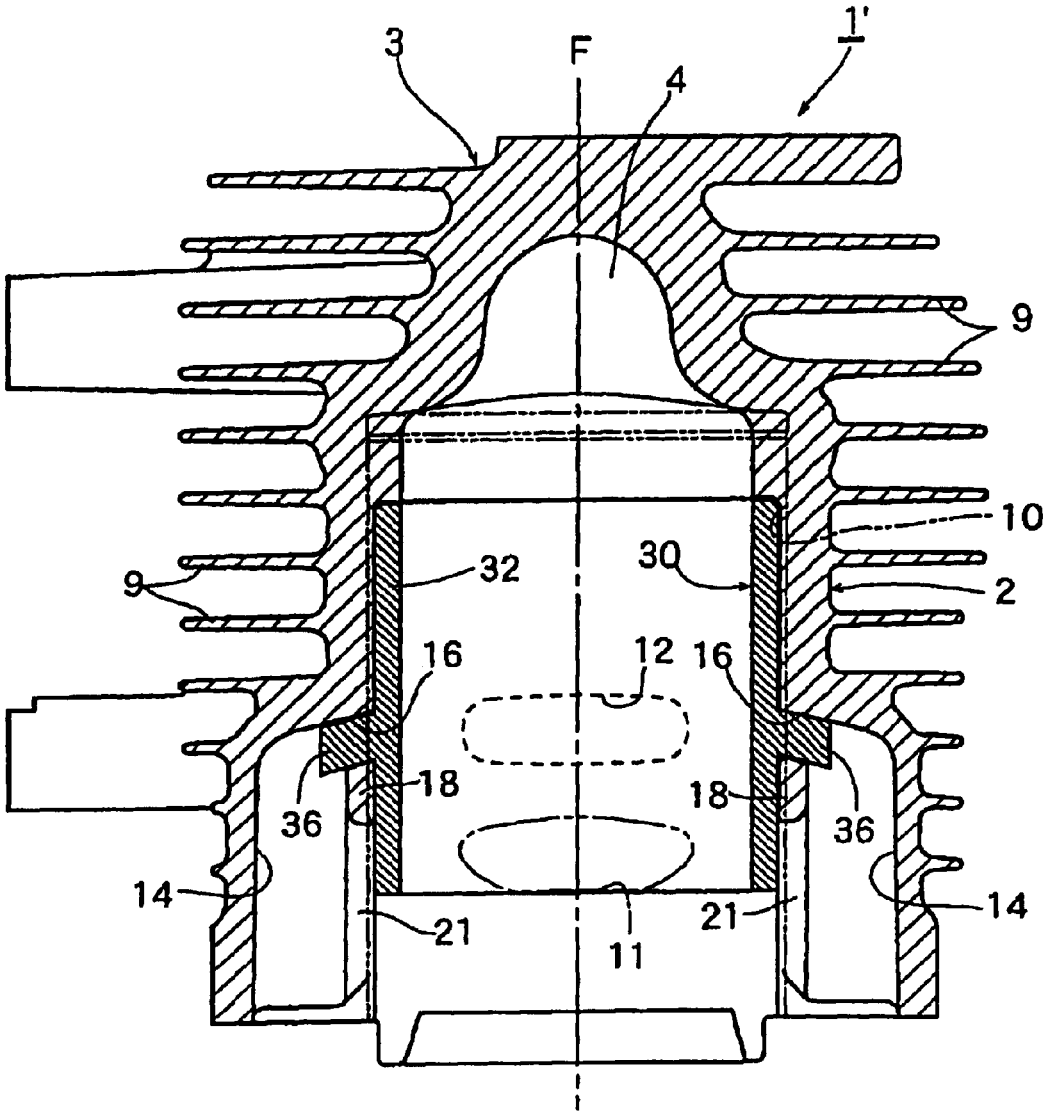
FIG. 9 is a longitudinal sectional view illustrating a raw cylinder which was obtained in the die casting process shown in FIGS. 7 and 8, wherein the scavenging duct is longitudinally sectioned.
Figure 10:
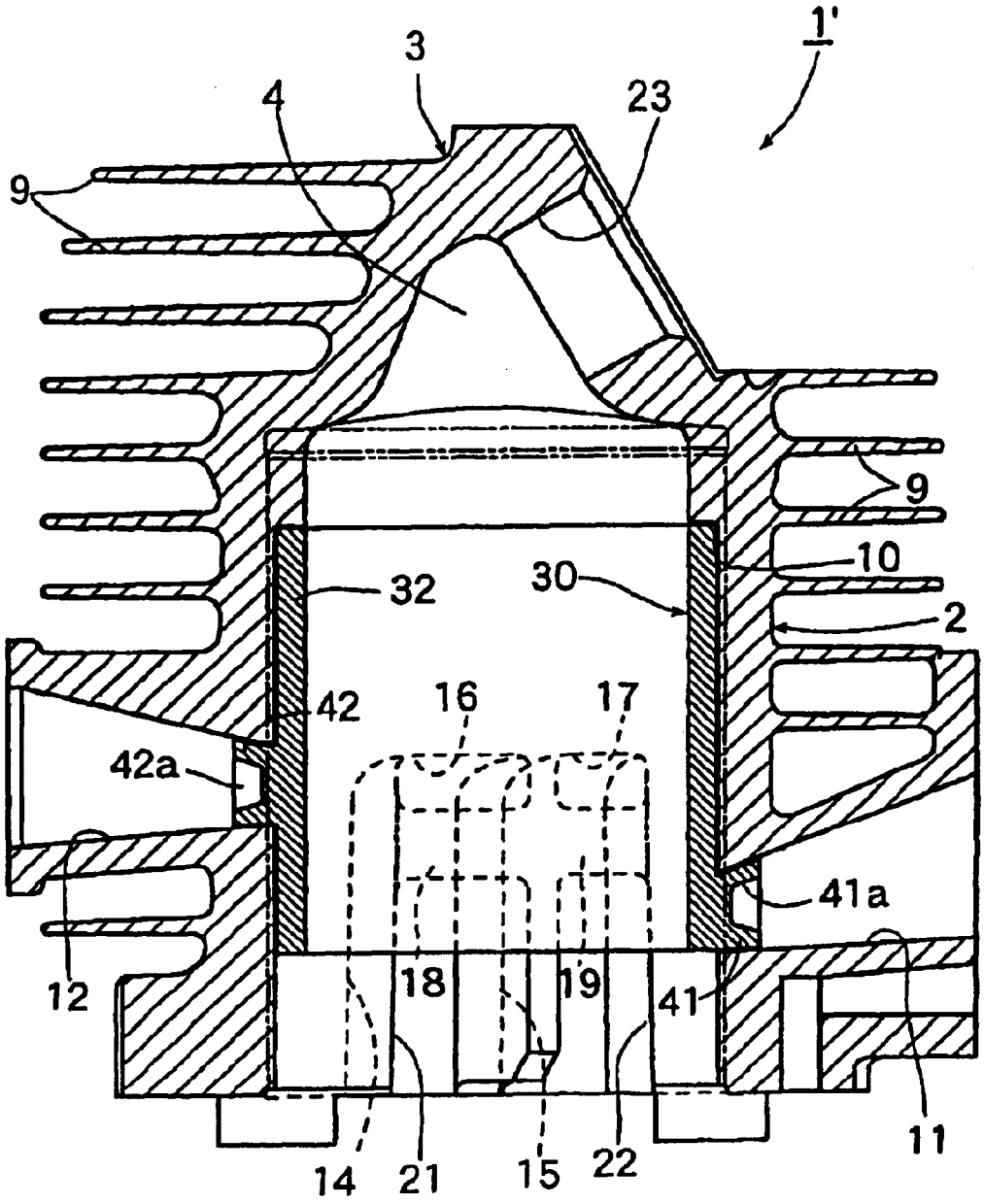
FIG. 10 is a longitudinal sectional view illustrating a raw cylinder body which was obtained in the die casting process shown in FIGS. 7 and 8, wherein the suction port and the exhaust port are respectively longitudinally sectioned.

As described above, the insert core 30 is set on the bore-core die 50, and the core 46 for suction port, and the core 47 for exhaust port are positioned as described above. Thereafter, as shown in FIGS. 7 and 8, the die casting by the process of high pressure die casting is performed. Subsequently, the bore-core die 50, the core 46 for suction port, and the core 47 for exhaust port are respectively pulled out to obtain a raw cylinder body 1' having the insert core 30 being left to remain therein as shown in FIGS. 9 and 10.

Under this condition, although the insert core 30 is closely adhered to the bore 10 of the raw cylinder body 1' thus obtained, there is no possibility of generating problem such as a fusion-bonding between these members due to the presence of the mold-releasing layer 38 which has been formed in advance on the outer surface of the insert core 30.

Figure 11:
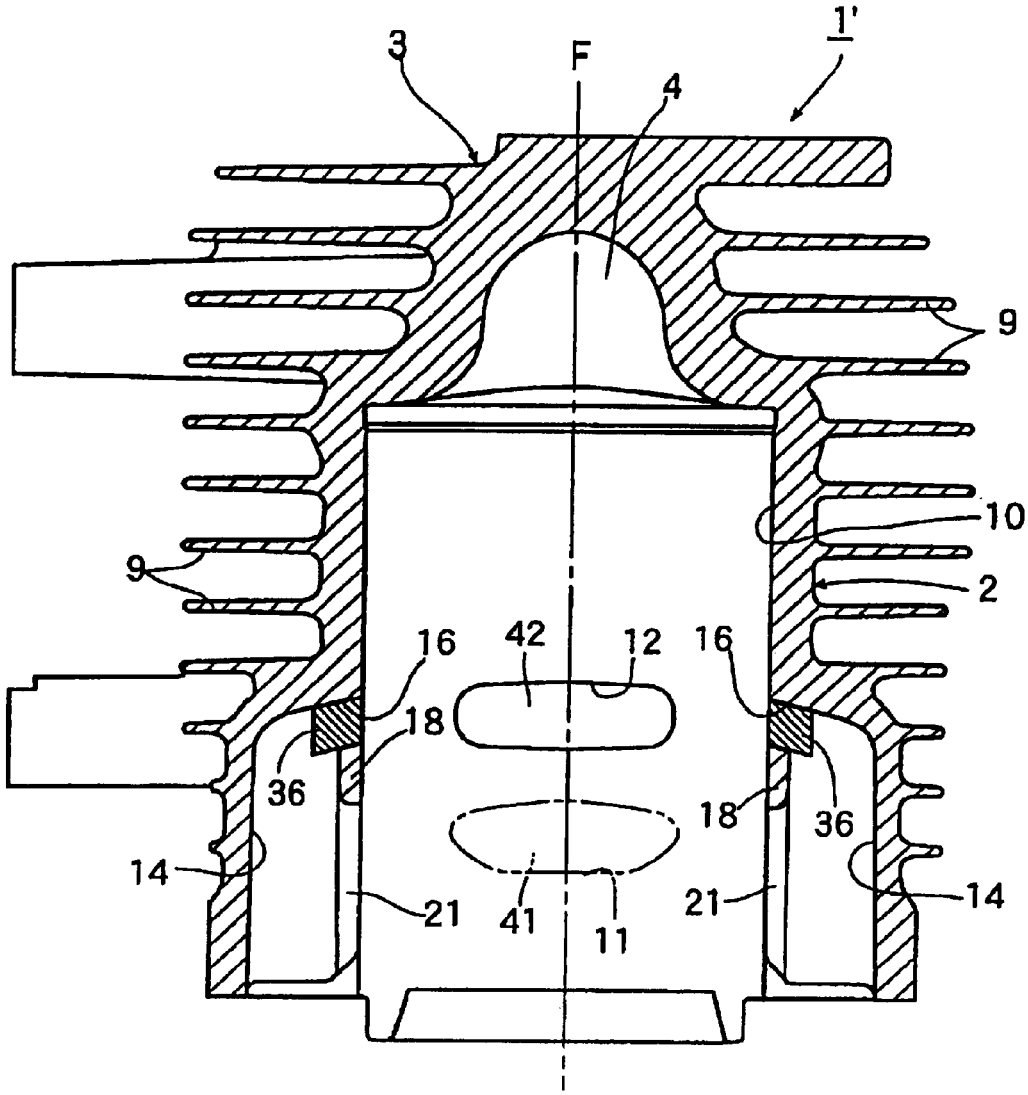
FIG. 11 is a longitudinal sectional view for illustrating a rough boring process for cutting and removing the cylindrical portion of the insert core, which can be performed by the rough boring of the cylinder bore of a raw cylinder body produced by a die casting process shown in FIGS. 9 and 10, wherein the scavenging duct is longitudinally sectioned.
Figure 12:
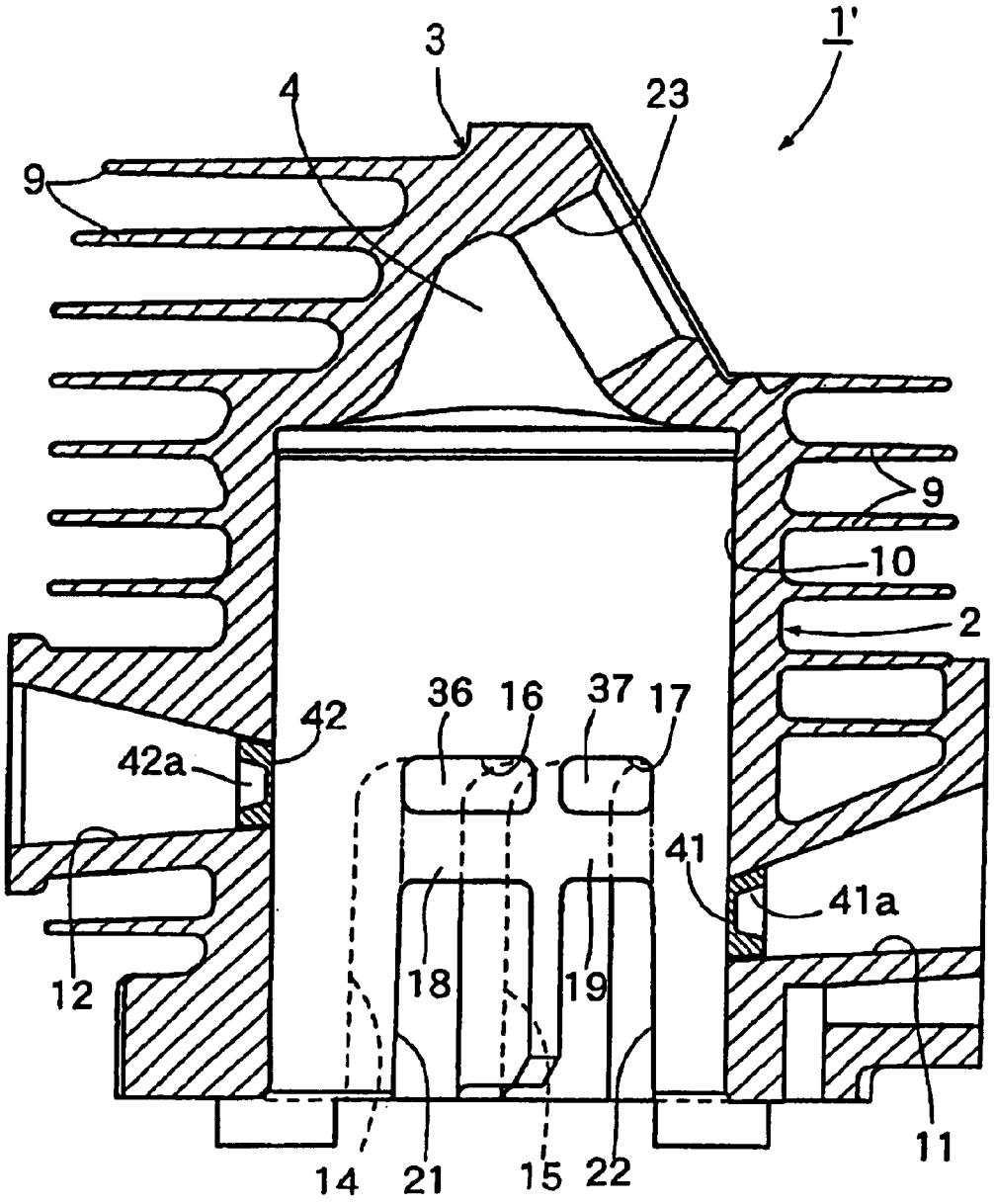
FIG. 12 is a longitudinal sectional view for illustrating a rough boring process for cutting and removing the cylindrical portion of the insert core, which can be performed by the rough boring of the cylinder bore of a raw cylinder body produced by a die casting process shown in FIGS. 9 and 10, wherein the suction port and the exhaust port are respectively longitudinally sectioned.

Thereafter, as shown in FIGS. 11 and 12, the rough boring of the cylinder bore 10 of the raw cylinder body 1' is performed to thereby cut off and remove the cylindrical portion 32 of the insert core 30. On this occasion, an upper end portion of the cylinder bore 10 (a raw material portion existing at an upper portion of the insert core 30) is also cut out and shaped simultaneously with the removal of the insert core 30.

Figure 13:
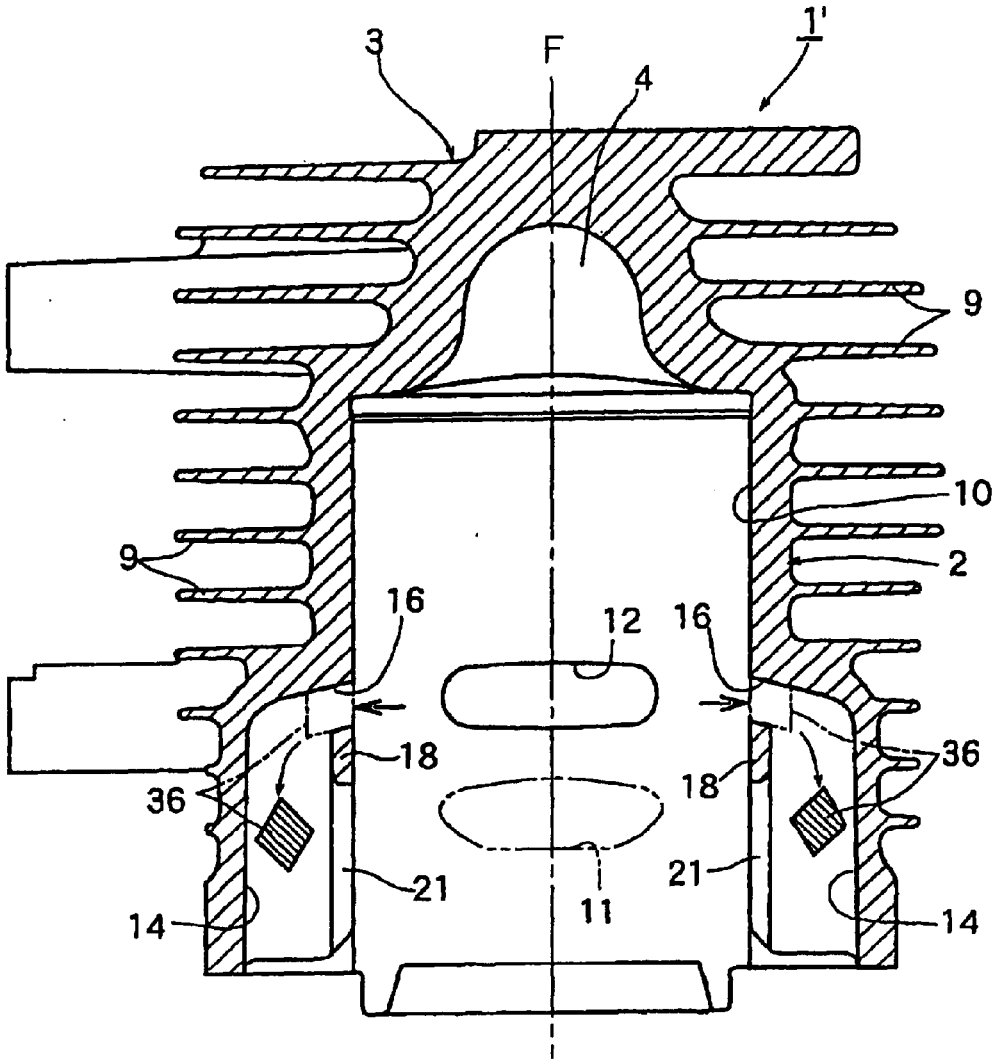
FIG. 13 is a longitudinal sectional view for illustrating a process of removing, by making use of a press, etc., the scavenging port-forming portion of the insert core that could not have been removed in the rough boring process shown in FIGS. 11 and 12, wherein the scavenging duct is longitudinally sectioned.
Figure 14:
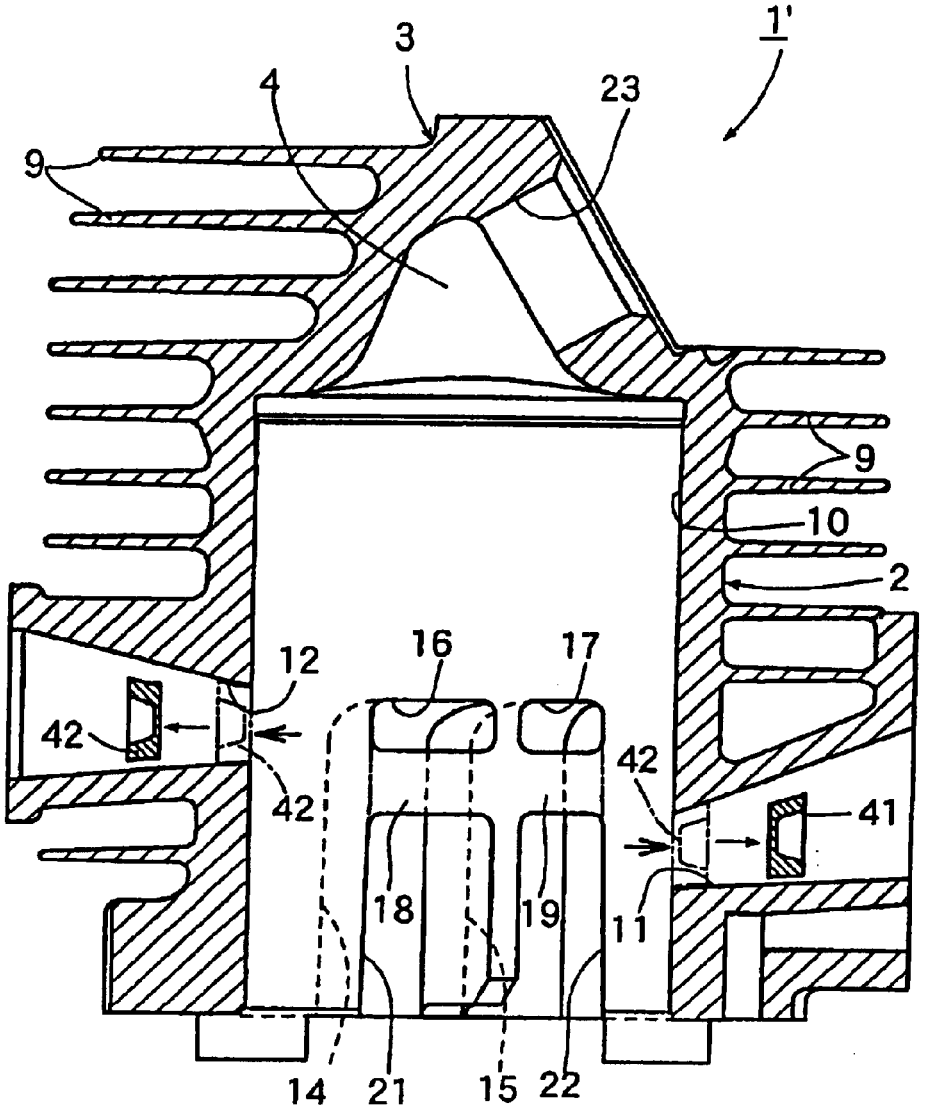
FIG. 14 is a longitudinal sectional view for illustrating a process of removing, by making use of a press, etc., the suction port-forming portion and exhaust port-forming portion of the insert core that could not have been removed in the rough boring process shown in FIGS. 11 and 12, wherein the suction port and the exhaust port are respectively longitudinally sectioned.

Then, as shown in FIGS. 13 and 14, the scavenging port-forming portions 36 and 37 of the insert core 30, which remain in the raw cylinder body 1' are pushed out toward the scavenging duct 14 and 15 by making use of a press, etc. to thereby remove the scavenging port-forming portions 36 and 37. In this case, since the mold-releasing layer 38 is formed in advance on the outer surfaces of the scavenging port-forming portions 36 and 37 as described above, and since the scavenging port-forming portions 36 and 37 are formed in a slightly downwardly inclined manner in the direction toward the scavenging duct 14 and 15 so as to extend along the scavenging ports 16 and 17, the scavenging port-forming portions 36 and 37 can be relatively easily removed by applying a pushing force thereto from the cylinder bore 10 side by making use of a press, etc.

Likewise, the suction port-forming portion 41 and the exhaust port-forming portion 42 which remain in the raw cylinder body 1' can be pushed out of the suction port 11 and the exhaust port 12, respectively by a press so as to remove them. In this case also, since the mold-releasing layer 38 is formed in advance on the outer surfaces of the suction port-forming portion 41 and the exhaust port-forming portion 42, and since these suction port-forming portion 41 and exhaust port-forming portion 42 are disposed at an inner end portion of these suction port 11 and exhaust port 12 which are respectively formed in a slightly gradually expanding manner in outward direction, these portions 41 and 42 can be easily removed by applying a pushing force thereto from the cylinder bore 10 side by making use of a press, etc.

Thereafter, the resultant cylinder body is subjected to a predetermined finishing work to obtain a finished cylinder 1 as shown in FIGS. 15 and 16.

According to an exemplary method of manufacturing a cylinder 1 for a two-stroke internal combustion engine which is described above and where the insert core 30 is employed, it is possible, due to the employment of the insert core 30, to utilize a high-pressure die casting method which enables one to obtain a cast article of high dimensional accuracy. Additionally, since the cylindrical portion 32 of the insert core 30 can be removed by rough boring the cylinder bore 10 after the die casting, and since the scavenging port-forming portions 36 and 37, the suction port-forming portion 41, and the exhaust port-forming portion 42 of the insert core 30 that could not be removed by the rough boring can be easily removed by making use of a press in a subsequent step, it is possible to make the resultant article (cylinder) completely free from any residuals of the insert core.

As a result, a cylinder can be manufactured in higher accuracy and at lower cost as compared with the conventional method of cutting out the scavenging port portion by mechanical means after die casting or with the conventional manufacturing method by die casting where an insert core to be inserted into the scavenging port portion is employed. At the same time, the aforementioned problems of the deterioration of heat conductivity, and the deformation or peeling of these port portions due to the remnant of the insert core in the cast article (cylinder) can be prevented from occurring.

Furthermore, since all of these scavenging port-forming portions 36 and 37, suction port-forming portion 41 and exhaust port-forming portion 42 are formed integral with the insert core 30 (the cylindrical portion 32 thereof), it is possible to univocally determine the relative positions of the scavenging ports 16 and 17, the suction port 11, and the exhaust port 12, thereby preventing the generation of relative mismatching among the scavenging ports 16 and 17, the suction port 11 and the exhaust port 12 that may occur in the conventional manufacturing method where these scavenging port-forming portions, suction port-forming portion and exhaust port-forming portion are provided separate from the insert core. Therefore, it is now possible to obtain a cylinder excellent in dimensional accuracy.

Additionally, since the configurations of these scavenging port-forming portion 36 and 37, suction port-forming portion 41, and exhaust port-forming portion 42 can be optionally selected as long as they can be detached or removed by pushing (or pulling) them toward the inside or outside of the cylinder bore 10 after the die casting, the configuration, contraction ratio and inclination angle of these scavenging ports 16 and 17, suction port 11, and exhaust port 12 can be optionally selected, thereby increasing the degree of freedom in designing these ports as compared with the case where these ports are formed by electric discharge machining and at the same time, it is possible to reduce the manufacturing cost of the cylinder.

While in the foregoing one embodiment of the present invention has been explained in detail for the purpose of illustration, it will be understood that the construction of the device can be varied without departing from the spirit and scope of the invention as claimed in the following claims. For example, the present invention is not limited to two-stroke combustion engines, but is also applicable to internal combustion engines generally.

What is claimed is:

1. A method of manufacturing a cylinder for an internal combustion engine, which is featured in that the cylinder is manufactured by a die casting method by making use of an insert core adapted for manufacturing a cylinder provided with an inner wall-attached hollow scavenging passageway having a scavenging port to be opened and closed by the movement of a piston, the insert core comprising:

a cylindrical body having substantially the same outer diameter as the diameter of bore of the cylinder to be obtained;

a scavenging port-forming portion projecting radially outward from the cylindrical body and having substantially the same cross-sectional configuration as that of the scavenging port;

a suction port-forming portion projecting radially outward from the cylindrical body and having substantially the same cross-sectional configuration as that of at least the cylinder bore-side end portion of a suction port; and an exhaust port-forming portion projecting radially outward from the cylindrical body and having substantially the same cross-sectional configuration as that of at least the cylinder bore-side end portion of an exhaust port;

the method comprising:

externally attaching the insert core to a bore-core die, the bore core die being capable of repeated use;

using the resultant casting die, cast molding a raw cylinder body with the insert core remaining therein;

subjecting the resultant raw cylinder body to boring for forming a cylinder bore to remove a cylindrical portion of the insert core; and removing by making use of a press the scavenging port-forming portion, suction port-forming portion and exhaust port-forming portion of the insert core, which remain in the raw cylinder body;

wherein the bore core die includes a columnar portion adapted to receive the cylindrical body of the insert core.

2. The method according to claim 1, wherein a parting agent is coated or plated on an outer surface of at least the scavenging port-forming portion, the suction port-forming portion and the exhaust port-forming portion of the insert core, thereby forming a mold-releasing layer prior to the step of die casting.

3. A cylinder for an internal combustion engine, which is manufactured by the method as claimed in claim 1.

4. A cylinder for an internal combustion engine, which is manufactured by the method as claimed in claim 2.

* * * * *